United States Patent [19]

Hogg

[11] 4,390,377

[45] Jun. 28, 1983

[54] NOVEL CONTINUOUS, HIGH SPEED METHOD OF GALVANIZING AND ANNEALING A CONTINUOUSLY TRAVELLING LOW CARBON FERROUS WIRE

[76] Inventor: James W. Hogg, 6216 Hillsboro Rd., Nashville, Tenn. 37215

[21] Appl. No.: 224,482

[22] Filed: Jan. 12, 1981

[51] Int. Cl.[3] ..... C21D 8/06

[52] U.S. Cl. ..... 148/12 B; 148/150; 148/156; 204/38 S; 204/210; 266/107; 427/433

[58] Field of Search ..... 148/12 B, 150, 156; 204/37 R, 38 S, 210; 266/104, 107, 112; 427/433; 428/659

[56] References Cited

U.S. PATENT DOCUMENTS

| | | | |
|---|---|---|---|
| 101,264 | 3/1870 | Hill . | |
| 213,015 | 3/1879 | Wahl et al. . | |
| 936,637 | 10/1909 | Kirk . | |
| 1,120,191 | 12/1914 | Gibbs . | |
| 1,133,628 | 3/1915 | Field et al. . | |
| 1,816,617 | 7/1931 | Schueler . | |
| 1,984,335 | 12/1934 | Crapo | 204/210 |
| 2,152,842 | 4/1939 | Evans | 205/1 |
| 2,197,622 | 4/1940 | Sendximir | 92/70.2 |
| 2,268,617 | 1/1942 | Pierce | 29/188 |
| 2,281,132 | 4/1942 | Young | 148/12 B |
| 2,283,868 | 5/1942 | Fowle et al. | 428/659 |
| 2,286,073 | 6/1942 | Edick et al. | 28/1 |
| 2,288,762 | 7/1942 | Winkler | 205/21 |
| 2,315,725 | 4/1943 | Moller | 117/114 |
| 2,326,629 | 8/1943 | Evans | 29/33 |
| 2,359,095 | 9/1944 | Elder et al. | 205/21 |
| 2,378,458 | 6/1945 | Avallone | 205/21 |
| 2,472,393 | 6/1949 | Avallone et al. | 117/130 |
| 2,482,978 | 9/1949 | Hacqua et al. | 148/12 |
| 2,686,354 | 8/1954 | Lundin | 29/189 |
| 2,697,869 | 12/1954 | Kingston et al. | 29/189 |
| 2,986,808 | 6/1961 | Schmedler | 29/196.2 |
| 3,058,840 | 10/1962 | Kerr et al. | 117/93 |
| 3,163,566 | 12/1964 | Jenkins et al. | 148/150 |
| 3,190,768 | 6/1965 | Wright | 117/93.2 |
| 3,343,930 | 9/1967 | Borzillo et al. | 29/196.2 |
| 3,393,089 | 6/1968 | Borzillo et al. | 117/114 |
| 3,476,579 | 11/1969 | Clarke et al. | 117/51 |
| 3,518,109 | 6/1970 | Halley | 117/93.2 |
| 3,632,392 | 1/1972 | Pierson | 117/64 |
| 3,730,758 | 5/1973 | Laidman | 117/51 |
| 3,782,909 | 1/1974 | Cleary et al. | 29/196.2 |
| 3,844,848 | 10/1974 | Stacey | 148/12 B |
| 3,952,120 | 4/1976 | Horton et al. | 427/433 |
| 3,959,035 | 5/1976 | Sheehan | 148/134 |
| 4,053,663 | 10/1977 | Caldwell et al. | 427/320 |
| 4,056,657 | 11/1977 | Leckie et al. | 427/433 |
| 4,228,200 | 10/1980 | Sander et al. | 427/47 |

FOREIGN PATENT DOCUMENTS

| | | | |
|---|---|---|---|
| 882431 | 3/1980 | Belgium . | |
| 887121 | 1/1981 | Belgium . | |
| 2146376 | 3/1972 | Fed. Rep. of Germany | 427/433 |

OTHER PUBLICATIONS

Drugov et al., "Hot Galvanizing of Steel", Protection of Metals, English Translation, May 1979, pp. 505–508.

Burns et al., Protective Coatings for Metals, Reinhold Publishing Corporation, N.Y., N.Y., 1939, pp. 79–81.

AMM-Galvanizing Section, Jun. 30, 1981, "New Zinc Alloy Poised For Commercial Tests", George Collie, pp. 15 and 19.

Galvanizing (Hot-Dip) by Heinz Bablick, 3rd Ed. Pub. by E. and F. N. Spon, Ltd., in 1950, pp. 208, 209, 213, 214, 221, 265, 266, 306–307, 377, 462, 463.

Metals Handbook, vol. 2, Heat Treating, Cleaning and Finishing, Published by American Society for Metals in 1964, p. 500.

The Making, Shaping and Treating of Steel, Published by U.S. Steel, J. M. Camp et al., 6th Ed., 1951, p. 942.

The Galvanizing Handbook by John R. Daesen, Published by Rheinhold Publishing Corp. in 1946, pp. 17–106.

Alloyed Zinc Coatings, Paul E. Schnedler, Published by Armco Steel Corp., p. 2.

Fe-Zn Alloy Formation During Galvannealing, by Smith et al., J. of the Iron and Steel Institute, Dec. 1972, pp. 897, 899.

*Primary Examiner*—Peter K. Skiff

*Attorney, Agent, or Firm*—Fisher, Christen & Sabol

[57] ABSTRACT

A continuous, high speed method of galvanizing and annealing a continuously travelling low carbon ferrous wire to provide a highly corrosion resistant, more ductile wire having a bright silvery luster comprising, (a) passing a continuously travelling low carbon steel wire after it has been cleaned through a zinc electroplating bath to deposit a zinc coating on the wire, (b) passing the resulting coated wire through a bath of molten aluminum-zinc eutectic alloy maintained at a temperature of about 734° F. to about 786° F. and comprising a major portion of zinc and sufficient aluminum to provide an aluminum-zinc alloy having a melting point less than that of zinc, to provide a coated ferrous wire, (c) drawing down the coated continuously travelling ferrous wire to a lesser cross-sectional area, (d) process annealing the drawn continuously travelling ferrous wire at a temperature up to about 1400° F. for a short period of time sufficient to relieve the stresses imparted to the wire by the drawing down step but not so long that inhibiting action of the aluminum content in the coating on the iron-zinc alloying action is completely overcome, and (e) thereafter quenching the annealed wire. Alternatively, especially for fine wires and/or where thin coatings are acceptable, step (a) the electroplating step can be eliminated and the wire, after it has been cleaned, can be passed directly through a molten bath such as that described above but maintained at a temperature to about 1040° F. or more and then subjected to steps (c), (d), and (e); however, the alternative method is less preferred.

13 Claims, 1 Drawing Figure

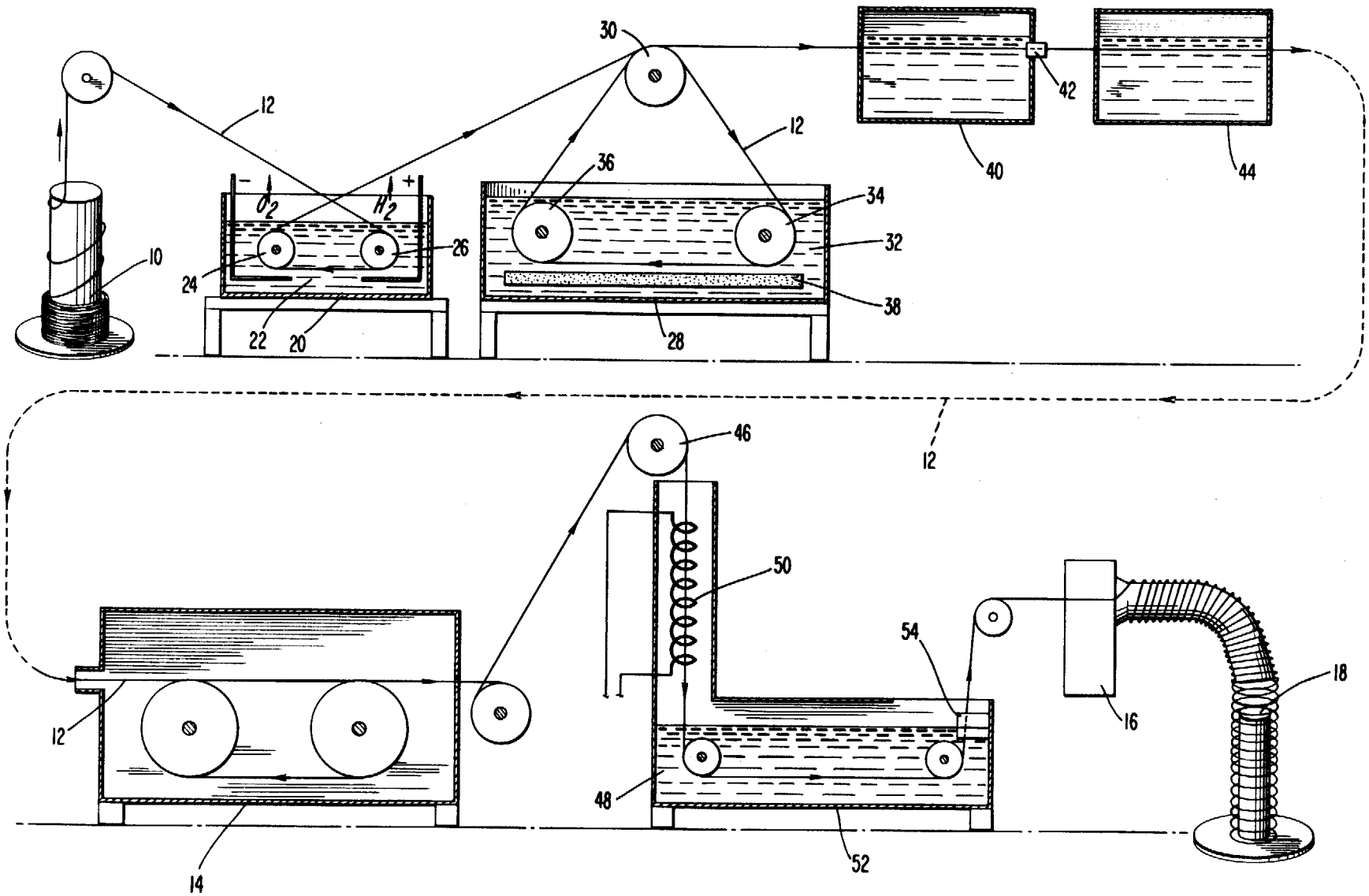
44
42
40
12
34
32
38
12
30
36
28
26
$H_2$
$O_2$
20
22
24
12
10
18
16
54
52
50
46
48
14
12

NOVEL CONTINUOUS, HIGH SPEED METHOD OF GALVANIZING AND ANNEALING A CONTINUOUSLY TRAVELLING LOW CARBON FERROUS WIRE

BACKGROUND OF THE INVENTION

1. Field of the Invention

This invention relates to the field of galvanizing wire such as steel wire to provide corrosion resistant wire having a bright, silvery luster and, more particularly, relates to the high speed, in-line, continuous production of galvanized, low carbon steel wire that can be process annealed without destroying the corrosion resistant coating or its silvery luster to provide a more ductile, galvanized wire of improved corrosion resistance.

2. The Prior Art

There have been numerous attempts at galvanizing steel wire or other elongate steel forms followed by drawing the wire down to a smaller diameter and many patents describing such attempts have been granted over the past century and more. The prior art processes were limited to the production of those types of galvanized wires having high hardness, low formability, and brittleness due to the inability of such prior art processes to provide for annealing after drawing without loss of some or all of the zinc coating, thereby reducing or destroying corrosion resistance, and/or oxidizing the surface of the zinc coating thereby destroying most or all of its appealing, bright, silvery luster.

U.S. Pat. No. 3,730,758 discloses a process for galvanizing steel strips by flash coating the steel strip with a metal, e.g., zinc, by vacuum deposition or electroplating followed by hot-dipping to apply a second coating of zinc. It states that the first flash coating can be of aluminum since an aluminum addition is normally made to galvanizing baths in order to decrease interface alloy formation of the zinc with the surface of the strip. It fails, however, to disclose a drawing or forming step after galvanizing, to provide the advantage of lower speed required through the galvanizing step and a faster speed through annealing, or to provide any annealing step to relieve the stresses introduced by the drawing or forming step or to disclose the provision of means by which the galvanized strip could be annealed without impairing the bright, silvery luster of the zinc coating.

Each of the U.S. Pat. Nos. 936,637; 1,133,628 and 1,816,617 discloses the precoating of steel wire with zinc by electrolytic means or with zinc flue dust followed by hot-dip galvanizing. None of these patents, however, teach the drawing down of the galvanized wire or the annealing of same after drawing and to do so would result in a rough unsightly surfaced wire having lower corrosion resistance, because the zinc would be oxidized and partially vaporized during the anneal.

U.S. Pat. Nos. 101,264; 2,286,073; 2,288,762 and 2,482,978 each disclose methods of galvanizing wire followed by drawing to elongate the wire and reduce its thickness. None of these patents disclose, teach or suggest the use of an annealing step after drawing to relieve the strains created by drawing, and to reduce the hardness and increase the formability of the drawn galvanized wire. If annealing were performed after drawing, the wire would be expected to have an unsightly rough dark finish due to heavy oxidation.

U.S. Pat. No. 2,378,458 discloses a process for precoating steel wire with copper or retard the formation of zinc-iron alloy upon galvanizing and to render the zinc coating more ductile and more easily worked. There is no disclosure, teaching or suggestion of annealing after drawing the galvanized wire to relieve the stresses created by the drawing operation or that a bright, silvery finish on the wire would result.

U.S. Pat. Nos. 2,152,842 and 2,326,629 disclose the coating of steel billets with a paint containing 70 parts Al, 23 parts sal ammoniac and 7 parts zinc to protect the billets from surface deterioration during subsequent reheating to hot rolling temperatures. The paint forms an alloy with the steel billet during the hot forming operation. Subsequent working and alternation of the alloy with the steel billet are required to give the alloy a degree of pliability and, after hot rolling, the billet may be cleaned and alloyed with zinc. After this complicated processing to form a suitable alloy on the steel billet surface, a second metal, e.g., aluminum or zinc is united to the surface in strip form or by congealing progressively or other involved alloying procedures utilizing aluminum and zinc powders can be used. In spite of this complicated procedure, the workpiece still is susceptible of separation of the coating from the steel billet and special dies are necessary to prevent separation.

U.S. Pat. Nos. 213,015; 2,268,617; 2,359,095 and 2,472,393 deal with various procedures utilizing copper coatings but none disclose, teach or suggest annealing after drawing nor do they disclose, teach or suggest that a bright, silvery finish is obtainable after annealing to relieve the strains of drawing.

The text titled Galvanizing (Hot-Dip) by Heinz Bablik, 3rd Edition, published by E. and F. N. Spon, Ltd. in 1950 discusses in depth the use of aluminum additions to hot-dip galvanizing baths. For the purpose of retaining the brightness of the zinc coating, amounts of 0.02% in the bath are adequate. Higher amounts of the order of 0.2 to 0.3% result in structural changes in the coating by delaying the reaction between the solid iron base and the molten zinc so that at short dipping times and low dipping temperatures no reaction takes place at all (p. 208). At higher concentrations of aluminum it is impossible to make liquid zinc react with solid iron and higher temperatures and longer dipping times are needed (p. 209). It suggests that pregalvanizing in molten zinc (without aluminum) produces a thin iron-zinc alloy with which the zinc bath containing aluminum (0.4%) can react readily but if higher concentrations of aluminum are added to the bath not even pregalvanizing is able to cause the reaction to start (p. 213). With a zinc bath containing 5% aluminum not even hot dip pregalvanizing is able to cause the initiation of the reaction at 440° C. (824° F.) (p. 214). At 0.24% aluminum (no pregalvanizing) the inhibition of the reaction is so strong that at 440° C. (824° F.) and one hour's immersion in the bath no reaction has yet occurred (p. 221; see also Metals Handbook Vol. 2, Heat Treating, Cleaning and Finishing, p. 500, published by American Society for Metals in 1964).

In order to obtain good adhesivity, according to the Bablik text, there must be a reaction between the iron base and the zinc coating and if inhibited by the presence of aluminum then the iron zinc alloy does not form and adhesivity suffers (p. 306–307). As little as 0.01% aluminum is able to impede the formation of dross almost completely (p. 377). The addition of aluminum to galvanizing baths is little practiced but if it is decided upon then 0.1 to 0.3% is added; however, due to the absence of iron-zinc alloy layers the resulting zinc coatings are quite flexible but are so light and thin as to be generally not desirable (p. 462). When galvanized wire is annealed it turns dark grey or green, partially vaporizes, and becomes rough surfaced due to oxidation and the iron-zinc reaction continues during annealing to increase brittleness and adhesivity (p. 463). Aluminum additions also substantially increase the fluidity of the bath and make the production of uniform heavy coatings difficult (p. 265, 266; see also The Making, Shaping and Treating of Steel, published by United States Steel, J. M. Camp et al, 6th Edition, 1951, p. 942).

None of these literature references, namely, Bablik, Metals Handbook or Camp, et al teach or suggest any advantage in using relatively large amounts of aluminum, namely, amounts sufficient to provide in the galvanizing bath a eutectic alloy having a melting point below that of zinc (e.g. about 420° C.) but not less than the melting point of the eutectic alloy of zinc and aluminum containing 5 wt.% aluminum. None of these references disclose, subsequent to galvanizing, the drawing and annealing of the galvanized wire without substantial removal or embrittlement of the zinc coating, loss of corrosion resistance or loss of brightness by oxidation or roughening of the coating surface. The references teach away from the use of the relatively large amounts of aluminum because of the purported adverse effects of the iron-zinc alloying reaction needed in a small degree to provide adhesivity and because of the purported undesirable increase of fluidity of the zinc bath with increasing aluminum content causing the bath to drain off the steel being coated and leaving coatings that are too thin. None of these references teach the sequence of steps of galvanizing, drawing and annealing.

The Galvanizing Handbook by John R. Daesen, pp. 17-106, published by Rheinhold Publishing Corporation in 1946; the text Alloyed Zinc Coatings, Paul E. Schnedler, p. 2, published by Armco Steel Corp. in a paper given at the "Proceedings of the Galvanized Committee", Sept. 1970; Fe-Zn Alloy Formation During Galvannealing, by Smith et al, J. of the Iron and Steel Institute, December 1972, pp. 897, 899; and Bablik, supra, at pages 462 and 463 each discuss the "galvannealing" process in which the zinc coated steel is subjected to elevated temperature, e.g., 850° F. to 1200° F. or as high as 1450° F. directly after removal from the hot zinc bath in order to promote the iron-zinc alloying reaction and thereby improve adherence of the coating to the steel base. The resulting galvannealed wire has an unappealing grey surface due to oxidation of the surface zinc layer and roughness due to cracking of the coating and is unsuitable for drawing because of the increased brittleness imparted by growth of the iron-zinc alloy layers.

The addition of the low amounts of aluminum, 0.08 to 0.25%, is recommended by the Daesen reference, the Schnedler reference and the Smith et al reference to inhibit the formation of the brittle alloy phases while permitting the development of the more workable iron-zinc alloy. Smith et al, p. 599 states that aluminum levels higher than 0.15% result in major discontinuities in the overall kinetics of alloying. Daesen, P. 60 states that the sacrificial nature of the protection given by zinc to iron requires for most work a thicker coat than can be secured uniformly in a bath of high (0.15%) aluminum content and recommends the maintenance of the aluminum content at a figure low enough to promote practical fluidity, 0.05% or thereabouts. The Schnedler reference confirms that, according to AISI terminology, the word "galvanneal" is usually applied to alloyed coatings with a light commercial coating weight. None of these references recommend the addition of relatively large amounts as mentioned above, of aluminum in the galvanizing bath nor do they disclose, teach or suggest the sequence of galvanizing, drawing and annealing.

SUMMARY OF THE INVENTION

This invention relates to a continuous, high speed, method of hot-dip galvanizing and annealing a continuously travelling ferrous wire to provide a highly corrosion resistant, more ductile wire having a bright silvery luster including, in a preferred mode, the steps of passing the continuously travelling ferrous wire, after it has been cleaned, through a zinc electroplating bath to deposit a zinc coating on the wire and then through a molten bath maintained at a temperature of about 734° F. to about 786° F. comprising a major portion of zinc and an amount of aluminum sufficient to provide in the galvanizing bath a eutectic alloy having a melting point below that of zinc (e.g. about 420° C.) but not less than the melting point of the eutectic alloy of zinc and aluminum containing 5 wt.% of aluminum based on the combined weight of the alloy of zinc and aluminum in the bath to provide a coating of zinc and aluminum on the wire. Heretofore, hot-dip galvanizing baths were operated at much higher temperatures such that precoatings of zinc already on the wire were washed off and the coatings of molten zinc and relatively high amounts of aluminum, e.g. 5%, relatively quickly flowed off of the wire prior to solidification reportedly resulting in extremely thin coatings of little or no value.

The present invention is based on the discovery that substantial thicknesses of a coating of zinc and of about 4 to about 6% aluminum can be applied to and solidified on ferrous wire to not only provide protection and a silvery luster to the wire but also to enable the drawing down of the wire to a less cross-sectional area without total loss of coating or sacrifice of brightness or corrosion resistance after annealing. In a preferred aspect of this invention a coating of zinc is first electrolytically applied to the wire in order to enhance the bondability of a subsequently applied coating of 4% to 6% aluminum-zinc. The preferred aspect is considerably advantageous when thicker wires in the range of about 0.028 inch or more are being galvanized and provides a stronger bonding even when thinner wires are being galvanized. It is well known that the alloy bond formed by the hot-dip zinc method is significantly slowed and sometimes arrested by aluminum which inhibits the iron-zinc reaction. The precoating of zinc applied by the electrolytic means is not substantially dissolved away when the precoated wire is subjected to hot-dipping, since the temperature of the hot-dipping bath is maintained below the melting point of zinc. Relatively substantial thicknesses are obtained by maintaining the temperature of the hot-dip bath below the melting point of zinc, namely, about 419.6° (787° F.) but substantially above the melting point of the aluminum-zinc bath (e.g., about 719.6° F. for the 5% Al-Zn bath) and is based in large part on the utilization of the lower melting point of the eutectic alloy of zinc and about 5% aluminum which is sufficiently below the melting of zinc to enable the application of the aluminum-zinc eutectic alloy below the melting point of zinc, such that coatings of zinc already adhering to the wire are not readily removed.

Alternatively, the application of the electrolytic zinc precoating before hot-dipping in the Al-Zn eutectic alloy can be dispensed with so that the wire after cleaning is directly passed through the molten Al-Zn eutectic alloy bath. The alternate method finds are especially for thin wires, e.g., about 0.028 inch diameter or less, which tend to heat up more quickly to the iron-zinc alloying temperatures than do thicker wires. In the alternate method the wire after cleaning is passed through the molten aluminum-zinc eutectic alloy bath in the manner described above. In order to promote a limited amount of iron-zinc alloying reaction, the temperature of the bath may have to be raised above the range specified in the preferred method, e.g. to about 1040° F. or more. Additionally, the residence time in the molten bath can be lengthened to assist in promoting a limited amount of iron-zinc alloying action. The extent of the iron-zinc alloying action is limited to provide an adequate bond between the zinc coating and the wire to hold the coating to the wire and is not so great as to cause brittleness in the coating which would cause drawing difficulties and/or a roughened, unattractive appearance to the wire.

This invention is also based on the utilization of the dramatic increase in speed of wire after drawing down and high speed annealing, e.g., at 2500 fpm, without encountering pay-off problems. The speed of the wire exiting a wire drawing machine can be as much as five or more times greater than the speed of the wire entering the machine. The present invention takes advantage of these differences of speed by galvanzing prior to drawing down and annealing after drawing down. Time-temperature requirements of hot-dip galvanizing, heat limitations because of electrical resistance of a wire in the electrolytic process, and mechanical limitations of the equipment dictate these slower speeds for galvanizing. Also, the lower galvanizing speeds provide adequate time for the limited iron-zinc alloying reaction to take place in the alternate method. The iron-zinc alloying reaction in the molten bath is time-temperature dependent. In the case of the preferred method, adequate time is needed to increase the thickness of the aluminum-zinc alloy coating to the desired degree. In both methods there is a speed consideration due to the mechanics and dynamics in the galvanizing system which can cause snarls and/or too much tension on the wire when excessively high speeds are used. Thus, after the wire has been coated with the aluminum-zinc alloy coating, with or without a precoating with electrolytic zinc, it is drawn down to a substantially smaller cross-section. Thereafter, the drawn continuously travelling low carbon ferrous wire is process-annealed at temperatures of about 1300° F. or more for a short period of time sufficient to relieve stresses imparted to the wire by the drawing step but not so long that inhibiting action of the aluminum content in the coating on the inherent iron-zinc alloying action and against oxidation is overcome. Thereafter, the annealed wire is quenched and packaged in the manner desired. During quenching the wire can be passed through a polishing die if the quench is a lubricant or after the quench in the standard manner. The polishing die can be sized for a 10% or less reduction and serves to smooth out, thus brighten the coating even more.

Before applying the zinc precoating or the aluminum-zinc coating to the wire, the wire should be appropriately cleaned in any suitable manner employed by the galvanizing industry. For example, a convenient means for cleaning is the "non-contact electrolytic cleaner" containing 8 to 16% sulfuric acid by volume and maintained at a temperature of about 140° F. or less. The wire is passed by electrodes making the wire alternately cathodic and anodic. Electrolytic action releases hydrogen and oxygen at the wire. The resultant bubbling action lifts off the oxides and soils from the wire. Any other suitable means for cleaning the wire can be employed.

Thereafter, the wire is passed directly into an electrolytic zinc plating machine wherein a coating of zinc is applied to the wire. The transit of the wire from the cleaning mechanism to the electrolytic coating machine is sufficiently quick to avoid oxidation of the surface of the wire. Any suitable electrolytic zinc plating machine or apparatus can be employed and a coating of zinc which is, illustratively, 3 to 7 microns thick is applied to the surface of the wire, that is, the zinc coating increases the overall radius of the wire an additional 3 to 7 microns and increases the overall diameter twice that amount. The temperature of the electrolytic bath in the electrolytic plating machine can vary from 30° to 70° C., and current densities of 1000 amperes per square foot more or less, consistent with the speed and diameter of the wire, can be used. Residence time in the electrolytic bath will vary depending upon many factors, such as the bath temperature, wire diameter, coating thickness required, current densities, concentration of zinc ions in the bath and other factors, the relationships of which are well known in the art. Illustratively, residence times for an 0.0274" diameter wire of 13 to 15 seconds are adequate to provide a suitable thickness zinc coating with approximately 70 feet of wire exposed to the electrolyte at a speed of 325 fpm.

After a zinc coating, illustratively, of a thickness of 3 to 7 microns, has been applied to the wire, the wire is subjected to a water rinse to wash off residual electrolyte and is then wiped with an air wipe to remove excess water. It is quickly passed into the hot-dip bath containing molten aluminum-zinc eutectic alloy containing a sufficient amount of aluminum to provide a eutectic alloy having a melting point below that of zinc; most preferably the eutectic alloy contains about 5% aluminum, preferably about 4 to 6% aluminum. The hot-dip bath can be of any suitable construction and various types of such equipment are available and/or are disclosed in the prior art. The temperature of the hot-dip bath must be maintained in the range of about 734° F. to about 786° F., in order to ensure the application of a suitable thickness of the aluminum-zinc coating on the wire. The melting point of mixtures of about 4 to about 6% aluminum and zinc ranges from approximately 730° F. (388° C.), the approximate melting point of the 4 and 6% aluminum-zinc mixtures, down to about 719.6° F. (382° C.) the melting point of the 5% aluminum-zinc mixtures. These temperatures are well below the melting point of substantially pure zinc which is about 787° F. (419.6° C.). It has been found that temperatures about 719.6° F., preferably 734° F. and above, are adequate to maintain the hot-dip bath in a molten condition and temperatures below about 786° F., are sufficiently low to avoid complete melting or dissolution of zinc already coated on the wire. Of course, temperatures that are well below the melting point of zinc yet above the melting point of the eutectic mixture of aluminum-zinc in the hot bath are preferred. Illustratively, the thickness of the coating of eutectic aluminum-zinc alloy applied in the hot-dip bath is about 3 to about 7 microns, preferably about 3 to about 5 microns.

The residence time of the wire in the hot-dip bath depends on many factors including the diameter of the wire being coated. Thicker wires normally require more time in which to initiate the reaction between zinc and iron that provides adequate bonding for the coating. Such a consideration would be secondary, however, in those cases where a precoating of the electrolytic zinc has been applied to the wire. Overall the residence time of wire which has not been precoated is considerably longer than the precoated wires in the hot-dip eutectic alloy bath. Uncoated wires cannot be galvanized much faster than 300 fpm; while precoated wires can reach 500 fpm. Uncoated wires have to be subjected to much higher temperatures in the 5% Al-Zn bath than a simple zinc melt to achieve adequate bonding. for example, an 18 gauge should be subjected to about 1040° F. for about 1 second to achieve adequate bonding with the eutectic alloy. Less time dictates even higher temperatures. When leaving the hot-dip aluminum-zinc bath, it is preferred to pass the wire through a sizing dye or a suitable wiping dye to smooth the aluminum zinc coating and maintain a uniform overall coated wire diameter. At this point the wire presented to the drawing machine has a soft outer skin of galvanize to facilitate drawing for it acts as a lubricant. The preferred method is almost or completely free of the hard alloys of iron-zinc found in hot-dip galvanizing. The electrolytic pure zinc substrate in the preferred method makes the galvanized wire superior to the one step hot-dip galvanized process when presented to the wire drawing machine because the zinc coating is soft, lubricating, resistant to flaking, die life is greatly extended. These characteristics reduce wear and prevent zinc build-up in the die which cause the wire to break while drawing.

After leaving the hot-dip bath, the coated wire is passed immediately into a water quench maintained at ambient temperatures, to quickly reduce the temperature of the coated wire and thereby reduce and avert oxidation of the surface of the coating. Following quenching with water the wire is subjected to the action of an air wipe to dry it.

Then the wire is passed to a drawing machine of any suitable type wherein it is reduced in cross-section. The reduction in the cross-sectional area can vary up to 95% reduction, preferably, from 65 to 90% reduction. The percent reduction is measured by subtracting the final cross-sectional area of the wire after drawing from the initial cross-sectional area of the wire before drawing, dividing the difference by the initial cross-sectional area and multiplying by one hundred. The drawing operation is carried out at ambient temperatures although the temperature of the wire increases substantially because of the mechanical working of the wire. The wire drawing operation, depending upon the total reduction, increases the speed dramatically. For example, an 0.075" wire drawn to a 0.0274" increases the speed from the range of about 330 to about 340 feet per minute prior to drawing to a speed in the range of about 2500 feet per minute after the drawing operation. All operations prior to the drawing operation, namely, cleaning, electrolytic plating, hot-dipping and water quenching are all carried out at about 200 or less to about 550 or more feet per minute. All operations subsequent to drawing are carried out at about 1500 or less to about 2500 or more feet per minute. Normal input speeds to a drawing machine, and therefore galvanizing speeds range up to 550 fpm with output or annealing speeds running up to or around 2500 fpm or more. During drawing, substantial stresses are built-up in the wire rendering it relatively more brittle and less ductile.

In order to provide a more useful product, the wire is subsequently annealed in such fashion that the aluminum-zinc coatings are not substantially diminished or destroyed and under such conditions that the coating is not rendered more brittle or more weakly bonded to the wire by excessive promotion of the iron-zinc-aluminum alloying action or under such conditions that the surface of the coating is not substantially oxidized or otherwise adversely affected. When the electrogalvanize precoat method is used, there is enough aluminum in the overcoat to diffuse through the underlying zinc to the substrate steel to inhibit this alloy growth. Therefore, the annealing operation must be performed quickly and under such conditions that the stresses are relieved and the inhibiting action of the aluminum content in the coating is not overcome sufficiently to render the coating unduly brittle due to iron-zinc alloying action or to render it dark and rough in appearance or less corrosion resistant due to oxidation.

While any suitable means of annealing which would observe the above conditions can be used, it has been found that annealing by induction is highly useful and efficient in achieving the desired results. A particularly useful arrangement is to guide the coated wire in a vertical direction down through an induction coil of suitable characteristics to heat the wire to a temperature of 1200° to 1500° F. with a residence time of about 0.29 or less to 0.48 or more seconds. The vertical disposition of the wire tends to avoid the form of a teardrop-like cross-section because of flow of the coating due to gravity and tends to retain the circular cross-section configuration of the wire.

In addition, it is highly important to avoid the application of stresses on the wire while it is in the heated condition during annealing so as to avoid thinning or other deformation of the wire. This is achieved by providing upper and lower capstans above and below the induction coil. Before entering the induction coil, the wire is wound several times around the upper capstan to prevent application of any forces from the upstream direction. After leaving the induction coil, the wire is wound several times around the lower capstan so that any downstream stresses are prevented from affecting the wire passing through the induction coil.

After leaving the induction coil, the annealed wire is passed immediately into an oil bath to quickly reduce the temperature to prevent oxidation. The lower capstan mentioned above can itself be mounted in the oil bath. The temperature of the oil bath should be maintained at ambient temperatures for effective quenching. A typical example of a reduction in the tensile of a wire would be from about 125,000 psi to about 75,000 psi. In addition, a polishing or finishing die, if desired, can be utilized in the oil bath in order to enhance the surface appearance of the galvanized, annealed wire by reducing the wire to the final desired size and by smoothing out and redistributing the coating evenly around the wire and to remove most of the residual oil. Thereafter, the wire is wound by a deadblock or any other suitable piece of equipment for coiling the wire, from which it is dropped onto the stem of a carrier or is spooled by a spooler onto a spool.

Instead of passing the wire immediately after annealing into an oil bath, it can be passed instead into a water quench and, thereafter, the wire can be air-wiped and passsed through a lubricated die after it emerges from the quench tank. The lubricated die finishes or polishes the coated wire to smooth out the coating evenly around the wire. Thereafter, the wire is passed to a deadblock or any suitable mechanism for spooling or otherwise packaging the wire. If a polishing die is used the percent reduction is normally under 10%.

The method of the present invention is applicable to a wide range of wire sizes ranging from 34 gauge (0.0104" in diameter), or finer, to 9 gauge (0.1483" in diameter), or thicker. The gauge system used herein is the "Steel Wire Gauge" system which is widely accepted in the industry. The method of this invention is especially preferred for galvanizing, drawing and annealing fine wires, i.e., of 17 gauge (0.0540" diameter) or finer because the great economic advantages provided by this invention and the inability heretofore to batch galvanize wire. While the diameter of a 9 gauge wire is a little more than fourteen times the diameter of a 34 gauge wire, the 34 gauge wire (3,463 ft./lb.) is more than 200 times longer per pound than the 9 gauge wire (17.03 ft./lb.). The 17 gauge wire (128.4 ft./lb.) is only about one third the diameter of a 9 gauge but is more than seven times longer. The present invention enables the pay-off, cleaning and galvanizing steps to be carried out at manageable, relatively lower speeds to provide better controls over these steps while, at the same time, permitting high rates of production of the final product.

The method of this invention provides compact self-contained modules which clean, galvanize, draw, and anneal in one continuous operation. The conventional method cleans and coats a carrier coat for subsequent drawing in one department. The second operation is drawing the wire in another department. The third operation is to process anneal and galvanize in the continuous mode in still another department. The method of this invention reduces the traditional three separate operations to one continuous operation. Certain economic benefits result from this invention:

1. Smaller companies can draw wire because the modules are compact. These small companies do not have to have the economy of scale that large companies enjoy. Investment is reduced.

2. Scrap is reduced because the operations no longer are segmented into the three traditional operations.

3. The space saving modules can be located at and decentralized to the using location, thus saving transportation and handling costs. Users of wire can now go into wire drawing. The economy of scale requirements is drastically reduced.

4. Labor efficiency is increased because people are more motivated if they are responsible for the making of the whole wire-cleaning it, galvanizing it, drawing it, and annealing it. Heretofore, these operations were separated. Further, it takes less time to make a pound of finished wire, e.g. (1) 0.0274" diameter wire can be completely finished in one continuous operation to produce galvanized, process annealed, 0.0100" diameter wire roughly 1.6 times faster than traditional methods, (2) 0.128" diameter wire drawn to 0.0605" diameter wire on the same basis is roughly 2.4 times faster.

Corrosion resistance is enhanced by the method of the present invention at both ambient temperatures and elevated temperatures by the 5% Al-Zn coating when compared to zinc. A surface of close to 5% Al-Zn is extremely effective against corrosion in industrial and salt water atmospheres as well as in elevated temperature applications. In a salt water-industrial type environment the relative corrosion currents of zinc and 5% Al-Zn are 4.3 milliamps per $cm^2$ and 1.8 milliamps per $cm^2$, respectively. The environment was a solution 0.1 N $H_2SO_4$+3.5% NaCl. In this environment the 5% Al-Zn exceeded the corrosion resistance of zinc by approximately 2.4 times. In a 3.5% NaCl solution corrosion current for pure zinc was 1.243 ma/$cm^2$; for 5% Al-Zn it was 0.380 ma/$cm^2$. The 5% Al-Zn was more corrosion resistant by a factor of 3.27 times the corrosion resistance of pure zinc in this salt water environment. In a solution of 0.1 N $H_2SO_4$ corrosion current for pure zinc was 4.6 ma/$cm^2$ as opposed to 3.1 ma for 5% Al-Zn. The 5% Al-Zn was 1.48 times more corrosion resistant than pure zinc in this acidic environment.

Furthermore, better corrosion resistance at high temperatures is obtained by this invention. The complete destruction of zinc at annealing temperatures was observed; however, the 5% Al-Zn did stand up at temperatures in the vicinity of 1400° F. for short durations.

DESCRIPTION OF A SPECIFIC EMBODIMENT

In the single drawing, there is shown diagrammatically the various steps of carrying out the method of the present invention. The parts illustrated are given by example only and are not intended to be limiting since the various steps may be performed by any apparatus, such as the standard apparatus well-known in the wire handling and treatment arts.

EXAMPLE

From pay-off coil 10, wire 12 travels at approximately 493 feet per minute to the wire drawing machine 14. As it is drawn down in the wire drawing machine 14 from 0.052" to 0.0223", the wire elongates, with an accompanying increase in speed. There is a total reduction of 82% in the cross-section of the wire. As the drawn wire 12 exits the wire drawing machine 14, it is moving at about 2300 feet per minute and continues at this velocity until it is coiled on the deadblock 16 and falls on the stem of carrier 18 in coiled form.

In a no-contact electrolytic cleaner 20, the wire makes multiple passes through an acid bath 22, in which are disposed non-conducting roller 26 and non-conducting roller 24 around which the wire 12 passes in alternating fashion for enough passes to adequately clean the wire. The wire 12 is thus alternately made cathodic and anodic. As it passes the positive electrode the wire becomes cathodic. When it passes the negative electrode the wire becomes anodic, finally exiting the bath in the anodic mode. The scrubbing action of the hydrogen and oxygen being released at the cathodic wire going around roller 26 and the anodic wire going around roller 24, respectively, is well known as are the repelling actions against dirt at the cathodic wire around 26 and against metallics at the anodic wire around 24. The preferred bath 22 contains approximately 8% by volume of sulfuric acid and is operated at a temperature of approximately 140° F. and a pH of under 2.

The wire 12, after cleaning, enters the electrolytic plating machine 28 by passing over the contactor 30 down into the $ZnSO_4$ electrolyte 32 and passing around a first non-conducting roll 34, then a second non-conducting roll 36, and back to the contactor 30. A zinc anode 38 is disposed in the zinc sulfate electrolyte 32 to continuously replenish zinc ions in the bath and the wire is made the cathode by a negative charge imparted to it by the contactor 30. The wire 12 continues this track, making as many multiple passes as necessary to plate from about 3 to about 7 microns, illustratively about 3 to about 5 microns, of electrolytic zinc on the wire's surface thereby increasing the wire's radius by about 5 to about 7 microns, illustratively about 3 to about 5 microns. The preferred electrolyte contains approximately 90 to 120 grams of zinc metal in the form of zinc sulfate per liter of water and about 150 to about 165 grams of $H_2SO_4$ per liter of water. The bath is operated in a temperature range of 86° F. to 158° F. The current density is over 1000 amps/ft.$^2$ and runs to about 1200 amps/ft.$^2$ with a plating time of 8–9 seconds to attain approximately 5 microns of electrolytic zinc thickness on the wire's surface, i.e., increases its radius by about 5 microns. After leaving the contactor 30, the wire 12 is rinsed with water and wiped with air.

Passing from the electrolytic plating machine 28, the wire 12 passes into a hot-dip bath 40 of molten zinc containing about 5% aluminum based on the combined weights of aluminum and zinc and receives an overcoat of 5% Al-Zn. The residence time of the wire 12 in bath 40 ranges from a little over a second to less than one second and the bath 40 is maintained at a temperature in the range of about 734° F. to 786° F. The wire 12 exits the bath 40 through a sizing die 42 or suitable wipe which allows an increase in thickness due to the 5% Al-Zn overcoating of about 2 to about 4 microns thickness on the wire's surface, depending upon the size of the die 42. The cumulative thickness of the electrolytic zinc coating and the overcoated 5% aluminum-zinc illustratively is about 5 to about 7 microns (i.e., on the wire's radius). This cumulative thickness as well as the thickness of the electrolytic substrate layer and the overcoat layer can be managed to suit the operator's particular needs above, below and within the ranges of thicknesses given above, by control of the time/current density relationship in the electrolytic bath 28, the temperature of hot-dip bath 40 as well as the time in the bath 40, and the hole diameter of the sizing die 42 or wipe.

Following the hot-dip bath 40, the wire passes into water quench 44 maintained at ambient temperature to quickly solidify the aluminum-zinc coating and prevent oxidation due to high temperature. After exiting the water quench 44 it is subjected to an air wipe.

Wire drawing machine 14 reduces the wire 12 to a size which is approximately 5 to 10% greater than the desired finished wire size. It exits drawing machine 14 and angles upwardly about fifteen feet above the floor and around capstan 46 with adequate wraps to prevent too much tension in the wire between capstan 46 and capstan 48 below it. The wire 12 passes downwardly through induction coil 50 in less than a second, reaching approximately 1400° F. and receiving a process anneal. At this temperature it has very little tensile strenth and the tension between capstans 46 and 48 is minimized by multiple wraps around each capstan. The wire takes several wraps around capstan 48 located in oil bath 52 to prevent transmittal of excessive tension back into the leg of wire 12 between capstans 46 and 48.

Oil bath 52 is maintained at ambient temperature and serves as a quench to reduce the wire's temperature to ambient temperature and also serves as the die lubricant for the polishing die 54 also located in the oil bath 52. This disc 54 serves to not only reduce the wire 12 to the final desired size but also to smooth out and redistribute the coating more evenly around the wire. Due to the anneal there may be some roughening and uneven distribution of the coating. Instead of the oil quench bath 52 there could be used a water quench with an air wipe and a lubricated die located between the water quench tank and deadlock 16 or spooler.

The finished wire is coiled on a deadblock 16 (or spooler for very fine wires), a commercially available piece of equipment, and dropped by gravity over the stem of carrier 18.

The method and apparatus disclosed hereinabove is also useful with some modification in producing brass-plated wire. In the brass-plating process, the above-mentioned electrolytic zinc bath is preceded by a copper-plating bath to provide a copper coating on the wire prior to step (a) of the preferred method. Thus, the copper coated wire is electroplated with zinc and then subjected to the remaining steps of the preferred method as described above, that is, (b) it is passed through a molten bath containing the aluminum-zinc eutectic alloy, to apply a coating of the aluminum-zinc alloy to the copper coated wire, which then is (c) drawn down to a lesser cross-sectional area and, thereafter, (d) annealed at a temperature up to 1400° F. After annealing, the wire takes on a bright brassy appearance and is (e) quenched. An advantage of this modification is that no special protective atmospheres are needed to avoid unsightly oxidation. Further, since the zinc is not converted to zinc oxide or iron-zinc alloy, as it would be if it were not protected by the eutectic aluminum-zinc alloy, diffusion of copper and zinc does take place during the anneal, producing a brass coating.

Also, the above-described methods including the preferred method or the alternate method can be employed to produce "black annealed wire" which is useful for certain applications. In this case, the galvanizing baths, i.e., the electrolytic zinc bath and the molten aluminum-zinc eutectic alloy bath, are substituted by an aqueous bath of copper sulfate, which can also contain tin, e.g., up to 8 wt.% based on the weight of copper, if desired, to facilitate the plating out of the copper on the wire. During passage through the copper sulfate bath, the wire is coated with copper which provides lubrication for the drawing operation (c) and which turns the surface of the wire to a uniform, attractive black color after the copper-caoted, drawn wire is annealed in step (d).

The wire is quenched in commercially available blackening solutions, such as compounds containing selenium and copper in mildly acidic form in order to promote adherence and improved color. Copper helps blacken the gray color produced by the selenium, it is believed, which, in turn, readily bonds to the steel to provide metallic bonding of the copper to the steel. An additional wipe of lubricating oil or wax with black dye further enhances corrosion resistance, color and adherence. An acrylic water-based oil or wax produce a shiny black surface or, alternately, a water-displaced dry film oil will produce a satisfactory black surface. An air knife facilitates removing the water producing a dry film. The black surface produced by the quench is amorphous allowing the oil or wax to penetrate to the metallic substrate thus locking in any black smut and also improving the adherence.

Alternately, the above-described galvanizing methods, including the preferred method or the alternate method, can be employed to produce the black annealed wire by employing commercially available blackening solutions containing copper, or copper and selenium, in mildly acidic form as the quenching bath following the anneal in the induction coil thereby producing the desired black color. The substrate thus is coated with 5% aluminum-zinc, eutectic alloy resulting in a highly corrosion resistant coating which will be preserved as it passes through the induction coil producing, when blackened by the above method, a very corrosion resistant black annealed wire due to the very corrosion resistant substrate of 5% aluminum-zinc under the black coating.

The methods and apparatus described hereinabove have additional uses and can be modified by adding other steps and procedures to the steps and procedures described hereinabove to provide beneficial effects and advantageous products.

What is claimed is:

1. A continuous, high speed, method of galvanizing and annealing a continuously travelling low carbon ferrous wire to provide a highly corrosion resistant, more ductile wire having a bright silvery luster comprising:

(a) passing said continuously travelling ferrous wire after it has been cleaned through a zinc electroplating bath to deposit a zinc coating on said wire, (b) passing the zinc coated wire through a bath of molten aluminum-zinc eutectic alloy maintained at a temperature of about 734° F. to about 786° F. comprising a major portion of zinc and sufficient aluminum to provide an aluminum-zinc alloy having a melting point below that of zinc and in the range of about 734° F. to about 786° F. to provide a coating containing zinc and aluminum on the wire, (c) drawing the coated continuously travelling ferrous wire down to a lesser cross-sectional area, (d) continuously annealing the drawn, continuously travelling, coated ferrous wire at a temperature above the melting point of the Zn-Al-Zn coating to about 1400° F. for a short period of time sufficient to relieve the stresses imparted to the wire by the drawing step but not so long that inhibiting action of the aluminum content in the coating on the iron-zinc alloying action and oxidation is completely overcome, and (e) thereafter quenching the annealed wire.

2. Method as claimed in claim 1 wherein the amount of aluminum in the molten aluminum-zinc eutectic alloy bath is about 5% by weight based on the combined weights of aluminum and zinc in the bath.

3. Method as claimed in claim 1 wherein the amount of aluminum in the molten aluminum-zinc eutectic alloy bath is about 4% to about 6% by weight based on the combined weights of aluminum and zinc in the bath.

4. Method as claimed in claim 2 wherein said wire is travelling at a speed of about 200 to about 550 fpm in steps (a) and (b) and is travelling at a speed of about 1500 to about 2500 fpm after being drawn down to step (c).

5. Method as claimed in claim 4 wherein the thickness of said coating deposited on the wire in said electrolytic bath and said zinc aluminum bath is about 5 to 8 microns thick.

6. Method as claimed in claim 2 wherein said coated, drawn ferrous wire is subjected to annealing for about one second.

7. Method as claimed in claim 2 wherein said annealing is carried out by induction heating.

8. Method as claimed in claim 7 wherein said wire is travelling vertically downward during said annealing step at a speed of about 1500 to about 2500 fpm.

9. Method as claimed in claim 2 wherein said quenching step is conducted in an oil bath.

10. Method as claimed in claim 9 wherein said annealed wire is passed through a polishing die in said oil bath.

11. Method as claimed in claim 2 wherein said coated wire is quenched in a water bath after passing through said molten bath of zinc and aluminum.

12. Method as claimed in claim 2 wherein said coated wire after passing through said molten bath is quenched by cold liquid or gaseous nitrogen sprays.

13. A continuous, high speed, method of galvanizing and annealing a continously travelling low carbon ferrous wire to provide a highly corrosion resistant, ductile wire having a bright silvery luster comprising:

(a) passing said continuously travelling ferrous wire after it has been cleaned through a molten bath maintained at a temperature of at least about 1040° F., comprising a major portion of zinc and sufficient aluminum to provide an aluminum-zinc alloy having a melting point below that of zinc to provide a coating of zinc and aluminum on the wire, (b) drawing the coated continuously travelling ferrous wire down to a lesser cross-sectional area, (c) continuously annealing the drawn, continuously travelling, coated ferrous wire at a temperature above the melting point of the Zn-Al coating to about 1400° F. for a short period of time sufficient to relieve the stresses imparted to the wire by the drawing step but not so long that inhibiting action of the aluminum content in the coating on the iron-zinc alloying action and oxidation is completely overcome, and (d) thereafter quenching the annealed wire.

* * * * *